US010131163B2

(12) United States Patent
De Boer

(10) Patent No.: US 10,131,163 B2
(45) Date of Patent: Nov. 20, 2018

(54) VACUUM LEVEL CALIBRATION FOR A WEB-BASED PRINTER

(71) Applicant: Océ Holding B.V., Venlo (NL)

(72) Inventor: Taco M. De Boer, Venlo (NL)

(73) Assignee: OCE-HOLDING B.V., Venlo (NL)

( * ) Notice: Subject to any disclaimer, the term of this patent is extended or adjusted under 35 U.S.C. 154(b) by 0 days.

(21) Appl. No.: 15/405,475

(22) Filed: Jan. 13, 2017

(65) Prior Publication Data

US 2017/0217219 A1 Aug. 3, 2017

(30) Foreign Application Priority Data

Jan. 28, 2016 (EP) ..... 16153097

(51) Int. Cl.

| | |
|---|---|
| ***B41J 11/00*** | (2006.01) |
| ***B41J 13/00*** | (2006.01) |
| ***B41J 11/06*** | (2006.01) |
| ***B41J 11/46*** | (2006.01) |
| ***B41J 15/04*** | (2006.01) |

(52) U.S. Cl.

CPC ..... *B41J 11/0085* (2013.01); *B41J 11/06* (2013.01); *B41J 11/46* (2013.01); *B41J 13/0009* (2013.01); *B41J 15/04* (2013.01)

(58) Field of Classification Search

USPC ..... 347/9, 16, 30

See application file for complete search history.

(56) References Cited

U.S. PATENT DOCUMENTS

| | | | | |
|---|---|---|---|---|
| 6,158,344 | A * | 12/2000 | Walker | H04N 1/00002 101/483 |
| 2010/0171788 | A1* | 7/2010 | Heo | B41J 2/16532 347/30 |
| 2012/0013668 | A1 | 1/2012 | Martinez-Guillen et al. | |
| 2014/0146106 | A1* | 5/2014 | Maeyama | B41J 11/0085 347/16 |

FOREIGN PATENT DOCUMENTS

WO WO 2013/026670 A1 2/2013

* cited by examiner

*Primary Examiner* — Lam Nguyen

(74) *Attorney, Agent, or Firm* — Birch, Stewart, Kolasch & Birch, LLP

(57) ABSTRACT

Method for calibrating a vacuum level for a web-based printer, comprising the steps of:

transporting a medium over a medium support surface comprising vacuum holes for applying a suction force to the image receiving member;

applying a suction force to the medium;

sensing the advancement of the medium for generating advancement data;

comparing the advancement data to a reference; and adjusting the suction force based on the comparison between the advancement data and the reference.

The present invention further provides an image forming apparatus.

17 Claims, 6 Drawing Sheets

Fig. 1A
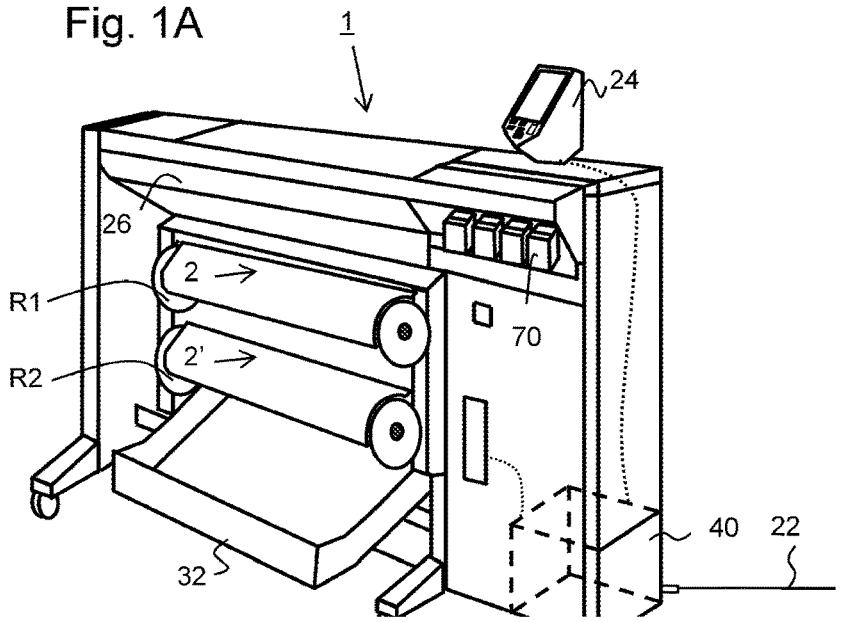
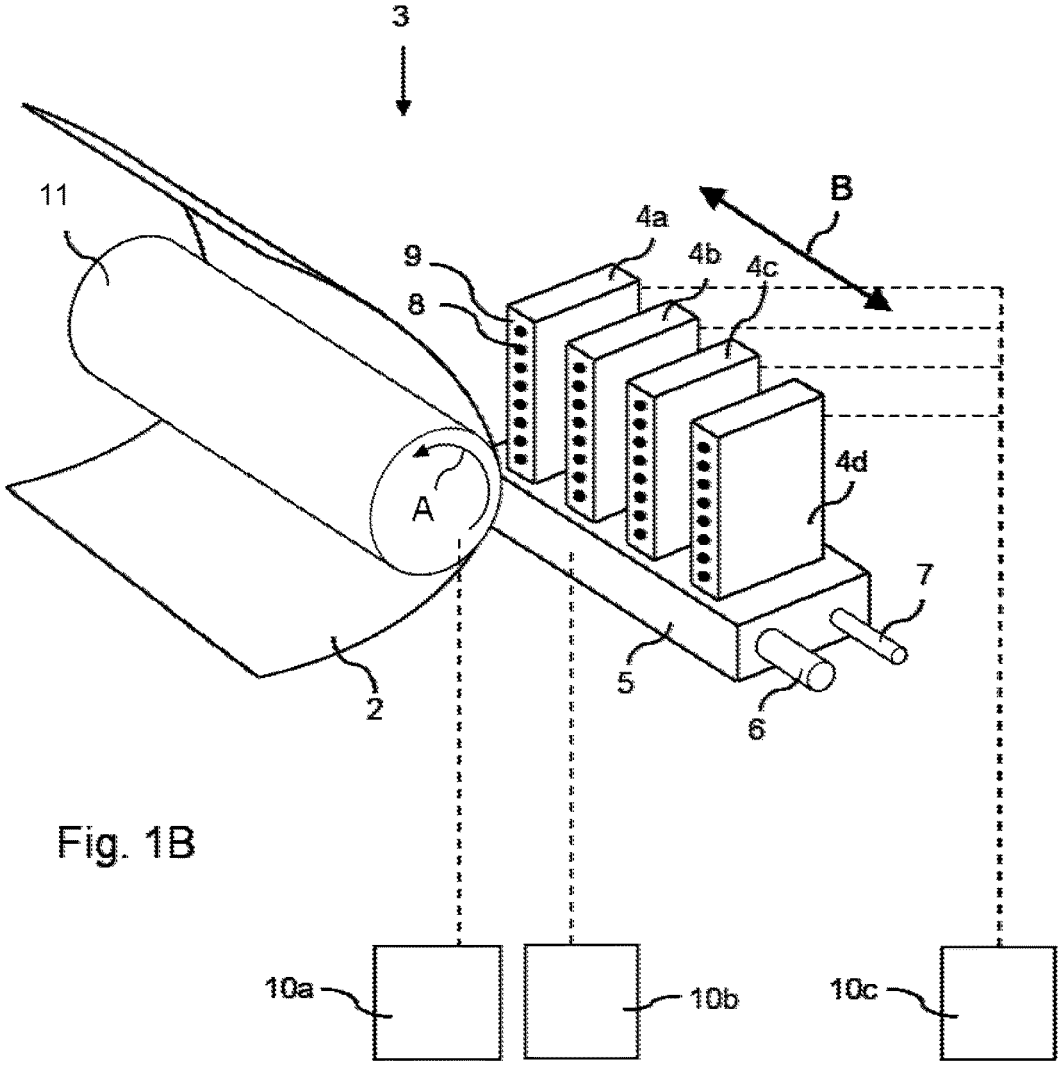
Fig. 1B

VACUUM LEVEL CALIBRATION FOR A WEB-BASED PRINTER

BACKGROUND OF THE INVENTION

1. Field of the Invention

Method for calibrating a vacuum level for a web-based image forming system and an image forming system.

2. Description of Background Art

Within wide format inkjet printing the media encounters increasing friction as the leading edge shifts over a medium support surface positioned below the print head(s). The medium support surface comprises a plurality of vacuum holes through which air may be sucked towards a suction unit, such as a vacuum pump or fan. Generally, a drive roller is arranged for pushing the web stepwise over the medium support surface. An excess suction force applied by the operator may then result in the deformation of the web. An insufficient suction force, however, may result in the web coming into contact with the print head. This so-called "head touch" may possibly damage the print head. Properties of the medium affect its behavior during transport, for example stiffness of the medium, porosity, its curl, or its tendency to curl. The medium's properties may in turn be affected by the atmospheric conditions, such as humidity and temperature. In practice the above mentioned behavior varies considerably with various media. Further, at the start of a print operation, as the leading edge of the web is "lead in" over the support surface, the web stepwise covers an increasing number of the vacuum holes, which vacuum holes exert a varying, generally increasing, suction force on the leading edge. This interplay of effects influences the step size. Since the image is printed in consecutive swaps, variations in step size will result in the consecutive overlapping swaths of the image becoming misaligned with respect to one another. Thereby, the printed image becomes disturbed and the print quality is reduced.

SUMMARY OF THE INVENTION

It is an object of the present invention to provide a method for determining a suitable suction force for a web, wherein the risks of "head-touch" or web deformation are reduced.

In accordance with the present invention, a method according to claim 1 and an image forming apparatus according to claim 9 are provided.

The method according to the present invention comprises the steps of:

- transporting an image receiving member over a medium support surface, which medium support surface comprises vacuum holes for applying a suction force to the image receiving member;
- applying a suction force to the image receiving member on the medium support surface;
- determining the advancement of the image receiving member for generating advancement data;
- comparing the advancement data to a reference; and
- adjusting the suction force based on the comparison between the advancement data and the reference.

It is the insight of the inventor that a suitable level of suction force may be determined from measuring the step spacing of a stepwise advancing medium. The advancement of the image receiving member provides a measure for a friction force on the image receiving member. This friction force may affect the advancement of the image receiving member, specifically when said friction force becomes sufficiently large to locally impede the movement of the image receiving member. In the latter case, the image receiving member advances irregularly, meaning its advancement deviates from the actuation of the drive roller, which drive roller is arranged for advancing the image receiving member along the transport path. In case the suction force is insufficiently large for properly holding the image receiving member against the medium support surface, the image receiving member will advance regularly, i.e. in correspondence with the actuation of the drive roller. Thus, a suitable suction force may be found by determining the transition between regular and irregular advancement of the image receiving medium from the advancement data and selecting the suction force accordingly. This ensures a secure holding of the image receiving member to prevent "head touch", while avoiding deformation of the image receiving member. Thereby, the object of the present invention has been achieved.

More specific optional features of the invention are indicated in the dependent claims.

The step of determining the advancement of the image receiving member may in a preferred embodiment comprise the direct or indirect determination of the advancement of the image receiving member. Preferably, the method according to the present invention comprises the step of sensing the advancement of the image receiving member. One or more quantities or parameters representing the advancement of the image receiving member may be sensed, for example position, displacement, orientation, velocity, and/or tension of the image receiving member. These quantities or parameters may then be processed to determine the advancement of the image receiving member. The advancement data may therefore comprise sensor data and/or processed data.

In an embodiment, the reference comprises advancement data generated in a previous step of determining the advancement of the image receiving device. The step of comparing the advancement data then comprises the step of comparing the advancement data to the previously generated advancement data.

In another embodiment, the reference may further comprise information related to a step size setpoint, which for example may be the input actuation command or value for the drive roller for advancing the image receiving member by desired step size or spacing. The determined advancement of the image receiving member is then compared to the desired or input step size. In an example, the reference may comprise one or more predefined thresholds or ranges to which the advancement of the image receiving member is compared.

In a preferred embodiment, the step of determining the advancement of the image receiving member comprises sensing an advancement indicator on the image receiving member. The advancement indicator may be a pattern, rows or series of markers on the image receiving member from which a step spacing corresponding to the advancement of the image receiving member in an advancement step may be derived. The advance indicator allows for a more accurate determination of the advancement of the image receiving member. The reference may then for example be a reference indicator, for example a pattern of markers, to which the sensed advancement indicator is compared preferably for determining any deviations between the reference indicator or pattern and the sensed advancement indicator. The reference may e.g. a first marker printed on the image receiving member before printing of a second marker. From the relative positions of these markers the advancement of the image receiving member is derivable.

In another embodiment, the method further comprises a step of printing a swath of the advancement indicator on the image receiving member, eliminating the need for providing media preprinted with such an advancement indicator. It is however within the scope of the present invention to utilize such preprinted media. The steps of printing, sensing, and comparing may be performed consecutively and/or in a cyclic manner. In an alternative embodiment, a plurality of swaths may be printed at different suction forces after which said plurality of swaths is sensed and compared to one another.

In an embodiment, the advancement indicator is formed by a plurality of swath-wise printed spaced apart markers wherein the step of comparing the advancement data comprises determining a spacing between two markers of the plurality of swath-wise printed markers. The spacing corresponds to the relative distance between different markers. The advancement indicator is printed in consecutive swaths, such that the spacing between consecutively printed swaths corresponds to the advancement of the image receiving member during an advancement step. From said spacing between swaths of the advancement indicator a repositioning of the image receiving member may be determined. For example, from a displacement vector between a first and a second marker an orientation, rotation, and/or deformation of the image receiving member is derivable.

In another embodiment, the step of comparing the advancement data to the reference comprises a step of determining an advancement step size and a step of comparing the advancement step size to a reference step size. The step size is determined from the advancement indicator, preferably by comparing data related to different swaths of the advancement indicator. The step size corresponds to the advancement of the image receiving member along the transport path in an advancement step. The step size may then be compared to a reference step size stored on a memory or a step size setpoint applied for actuating the drive roller. In another embodiment, a rotation or deformation of the image receiving member may be determined from the comparison of the advancement data.

In an embodiment, the step of adjusting the suction force comprises reducing the suction force when the advancement data deviates from the reference. When the comparison step yields a difference between the sensed advancement indicator and the reference, it is an indication that the image receiving member advancement deviates from its desired value. For example, when the comparison yields that determined step size is smaller (e.g. by a predetermined minimum amount) than the step size setpoint for the drive roller, the vacuum level and thereby the suction force is reduced. Thereby the friction or holding force on the image receiving member is reduced. This process is repeated until the determined or sensed step size corresponds to the step size setpoint. Thereby, the maximum suction force which allows for unimpeded movement of the image receiving member may be determined.

In a further embodiment, the step of adjusting the suction force comprises increasing the suction force when the advancement data is similar to the reference, for example when two advancements steps are of similar size. When the sensed advancement indicator or pattern is equal to a previously sensed advancement indicator or a reference indicator, the suction force is iteratively increased until a deviation between the reference and the sensed advancement indicator is determined (wherein said deviation may be a desired value or zero). This deviation indicates an upper limit for the suction force, below which upper limit deformation and/or rotation of the image receiving member is avoided.

In a further embodiment, the method according to the present invention further comprises the step of printing a swath of the advancement indicator along an edge, specifically a side edge and/or leading edge, of the image receiving member. The advancement indicator may be printed alongside an image on the image receiving member. By sensing the advancement indicator after printing each swath, the suction force is kept at a suitable level and a highly accurate stepping of the image receiving member is achieved.

In another embodiment, the method according to the present invention further comprises the step of printing a swath of the advancement indicator along on a leading edge region of the image receiving member. The leading edge region is adjacent the leading edge and has a length substantially similar to the length of the medium support surface. During "lead-in" the leading edge region covers an increasing number of vacuum holes in the medium support surface, which affects the suction force on the image receiving member. By printing and sensing swaths of the advancement indicator, the suction force may be adjusted to a suitable level during "lead-in" in an efficient manner. An advancement curve based on a plurality of advancement data may be determined and compared to a reference curve to accurately control the media advancement. When such data curves are used, time may be saved by selectively sensing advancement steps.

In a further aspect, the present invention provides an image forming apparatus, comprising a roll support for an image receiving member, which roll support is positioned at an end of a transport path, an inkjet printing assembly positioned along the transport path and arranged for applying an image on the image receiving member, a medium support surface positioned along the transport path opposite the inkjet printing assembly, which medium support surface is provided with vacuum holes for supplying a suction force to the image receiving member, a suction unit for controlling an air flow through the vacuum holes, a sensor device arranged for determining the advancement of the image receiving member and for generating advancement data, and a control unit comprising a processor arranged for a comparison between the advancement data and a reference, which control unit is arranged for controlling the suction unit to adjust the suction force based on said comparison. The sensor device, preferably provided upstream of the inkjet printing assembly, senses a measure or parameter for determining the step size of the image receiving member in an advancement step. Each advancement step may be sensed, but it lies within the scope of the present invention to determine one or more individual steps of a plurality advancement steps to increase production speeds. The processor compares this determined step size to the reference, being for example a previously measured step size or a predefined desired step size setpoint, and adjusts the suction force accordingly by controlling the suction unit. The processor iteratively determines the suitable (or maximum allowable) suction force (or range for said suction force) at which the measured step size begins to deviate from the reference. Thereby, a suitable suction force may be set without interference by an operator.

In an embodiment, the image forming apparatus further comprises a drive roller for advancing the image receiving member along the transport path, wherein the control unit is arranged for transmitting a step size setpoint to the drive roller for actuating the drive roller. The image forming apparatus according to the present invention may be applied for both pulling transport as well as pushing transport of the image receiving member. The roll support with its drive roller may thus be provided upstream or downstream of the transport path for respectively pushing or pulling the medium along the transport path. The roll support may thus be positioned at an end of the transport path in the form of an actuatable take-up roller for receiving a medium or an actuatable take-out roller for supplying a medium. In an even further embodiment, a take-up roller and a take-out roller both comprising drive rollers may be applied within the scope of the present invention.

In a preferred embodiment, the inkjet assembly is arranged for providing an advancement indicator on the image receiving member, and wherein the sensor device is arranged for sensing the advancement indicator on the image receiving member. By applying the inkjet assembly for depositing the advancement indicator, no additional device for providing the image receiving member with said indicator is required.

In another embodiment, the sensor device is arranged for sensing one or more quantities or parameters representing the advancement of the image receiving medium. The sensor device may for example be arranged for sensing a position, velocity, height map, deformation, and/or tension for the image receiving member. Further, the sensor device may sense the angular position of the roll support or its motor to determine the step size. Data from the sensor device is transmitted to the processor, which is arranged for determining the advancement of the image receiving member from said sensor data.

In another embodiment, the processor is further arranged for determining an advancement step size and for comparing the advancement step size to a reference step size. In a further embodiment, the control unit is arranged for reducing the suction force when the determined advancement step size deviates from the reference step size, which may for example be the step size setpoint. The vacuum level or suction force is reduced to a level wherein the sensed step size corresponds to the reference. Said level allows for a suitable, preferably maximum, holding force without hindrance to the transport of the image receiving member.

In an even further embodiment, the advancement indicator comprises a plurality of markers spaced apart with respect to one another in a transport direction of the transport path. Preferably the markers are printed in consecutive swaths, for example in rows or a grid-like pattern. A first marker printed in a first swath and a second marker in a second swath printed after said first swath are compared to one another. The first and second swaths need not be consecutive swaths. The relative position of the first and the second marker are determined, specifically their spacing or the distance between them. When projecting the distance between said markers along the transport direction the step size may be determined. Similarly a rotation of the image receiving member may be determined comparing an orientation of a distance vector between the two markers to the transport direction. Similarly a deformation of the image receiving member may be derived from the spacing between said markers. Thus, the spacing or distance between the first and second markers corresponds to the advancement of the image receiving member and provides a direct and easy means for controlling the suction level based thereupon. Preferably, the first marker is compared to a plurality of further markers, one or more of which (or each of which) are printed in different swaths with respect to one another to increase the accuracy.

In another embodiment, the inkjet assembly is arranged for providing an advancement indicator on the image receiving member, which advancement indicator is formed by a plurality of swath-wise printed spaced apart markers, and wherein the processor is further arranged for determining an advancement step size by determining a spacing between two markers of the plurality of swath-wise printed markers. The sensor device is arranged to distinguish the different markers, such that the spacing between two or more markers can be determined by the processor. The advancement step size can thus be derived from said spacing. When the advancement step size deviates from the reference, the vacuum level is adjusted accordingly by the controller.

It will be appreciated that the image forming apparatus according to the present invention may comprise an inkjet printing assembly with a translatable print head array or a page wide print head array.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 1A is a perspective schematic view of an image forming apparatus according to the present invention;

FIG. 1 B is enlarged view of the inkjet printing assembly of the image forming apparatus in FIG. 1;

DETAILED DESCRIPTION OF THE PREFERRED EMBODIMENTS

Figure 2:
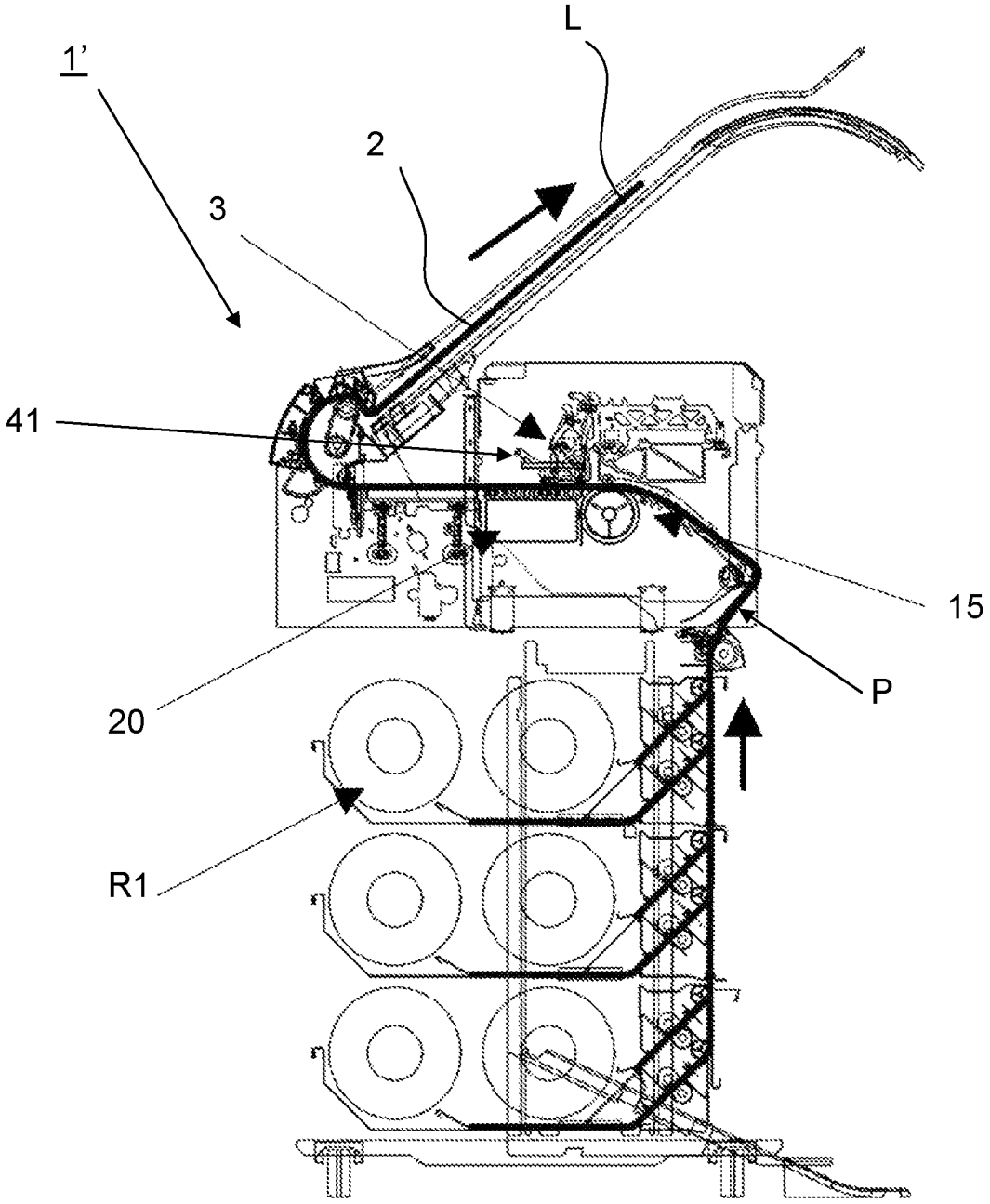
FIG. 2 is a schematic cross-sectional view of a further embodiment of an image forming apparatus according to the present invention.

The present invention will now be described with reference to the accompanying drawings, wherein the same reference numerals have been used to identify the same or similar elements throughout the several views.

FIG. 1A shows an image forming apparatus 1, wherein printing is achieved using a wide format inkjet printer. The wide-format image forming apparatus 1 comprises a housing 26, wherein the inkjet printing assembly 3, for example the ink jet printing assembly 3 shown in FIG. 1B is placed. The image forming apparatus 1 also comprises a storage means for storing image receiving member 2, 2', a delivery station 32 to collect the image receiving member 2, 2' after printing and storage means 70 for marking material. In FIG. 1A, the delivery station 32 is embodied as a delivery tray 32. Optionally, the delivery station 32 may comprise processing means for processing the image receiving member 2, 2' after printing, e.g. a folder or a puncher. The wide-format image forming apparatus 1 furthermore comprises means for receiving print jobs and optionally means for manipulating print jobs. These means may include a user interface unit 24 and/or a control unit 40, for example a computer.

Images are printed on an image receiving member 2, 2', for example paper, supplied by a roll 2, 2'. The roll 2 is supported on the roll support R1, while the roll 2' is supported on the roll support R2. Printed sheets of the image receiving member 2, 2', cut off from the roll 2, 2', are deposited in the delivery tray 32.

Each one of the marking materials for use in the printing assembly are stored in four containers 70 arranged in connection, preferably fluid connection, with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 40 placed inside the printing apparatus 1. The control unit 40, for example a computer, comprises a processor adapted to issue commands to the print engine, for example for controlling the print process. The image forming apparatus 1 may optionally be connected to a network N. The connection to the network N is diagrammatically shown in the form of a cable 22, but nevertheless, the connection could be wireless. The image forming apparatus 1 may receive printing jobs via the network. Further, optionally, the controller 40 of the printer 1 may be provided with a USB port, so printing jobs may be sent to the printer via this USB port.

FIG. 1B shows an ink jet printing assembly 3. The ink jet printing assembly 3 comprises supporting means 11 for supporting an image receiving member 2. The supporting means 11 are shown in FIG. 1B as a platen 11, but alternatively, the supporting means may be a flat or a curved surface. The platen 11, as depicted in FIG. 1B, is a rotatable drum 11, which is rotatable about its axis as indicated by arrow A. The supporting means 11 may be optionally provided with suction holes (25 in FIG. 3) for holding the image receiving member 2 in a fixed position with respect to the supporting means 11. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 11, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 11, such as to enable scanning of the image receiving member 2 in the main scanning direction B. Only four print heads 4*a*-4*d* are depicted for demonstrating the invention. In practice an arbitrary number of print heads may be employed, for example a fixed or static page-wide print head array. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds or thousands of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 7:
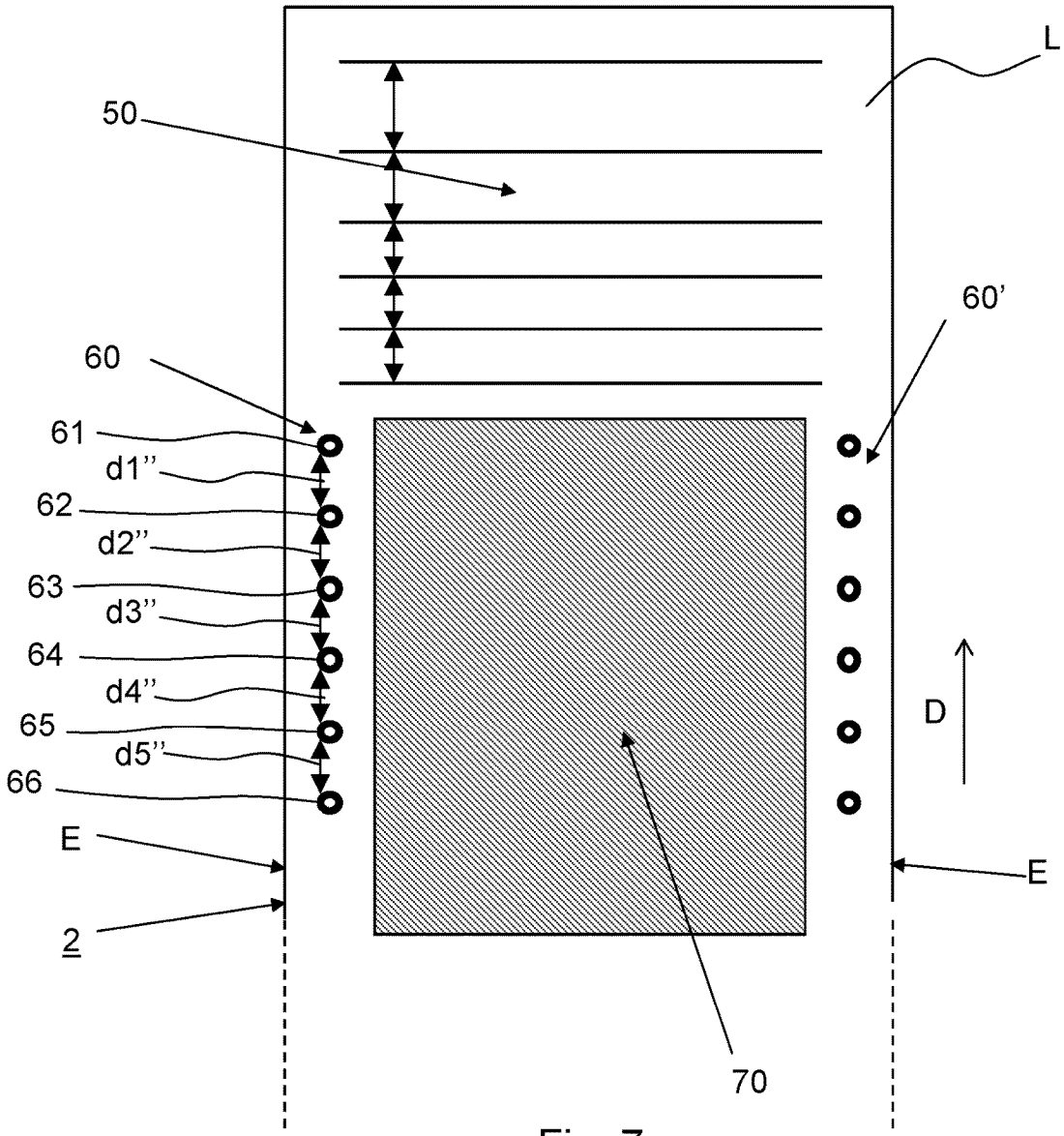
FIG. 7 is a schematic top view of a leading edge of web provided with an advancement indicator according to the present invention on its leading edge region and edges.

FIG. 2 depicts a cross-section of another embodiment of an image forming apparatus 1' according to the present invention, which in FIG. 2 is a printing system or printer. An image receiving member 2 in the form of a web 2 is transported from a roll support R1 over a transport path P to an image forming apparatus 2. Opposite the inkjet printing assembly 3 a medium holding device 20 is provided for supporting and holding the image receiving member 2 onto a medium support surface (14 in FIG. 2). A drive roller 15 is provided upstream of the medium holding device 10 for transporting the image receiving member 2 over the medium support surface (24 in FIG. 3). The drive roller 15 may stepwise advance the image receiving member 2 over the medium support surface 24, such that the inkjet printing assembly 3 is able to print consecutive swaths of an image (70 in FIG. 7) onto the image receiving member 2. After printing, the image receiving member 2 is guided towards an output unit of the image forming apparatus 1'. Downstream of the inkjet printing assembly 3 a sensor device 41 is provided for sensing an advancement of the image receiving member 2. The sensor device 41 is arranged for generating data, which is compared to a reference for controlling the suction force on the image receiving member 2 applied by the medium holding device 20.

Figure 3:
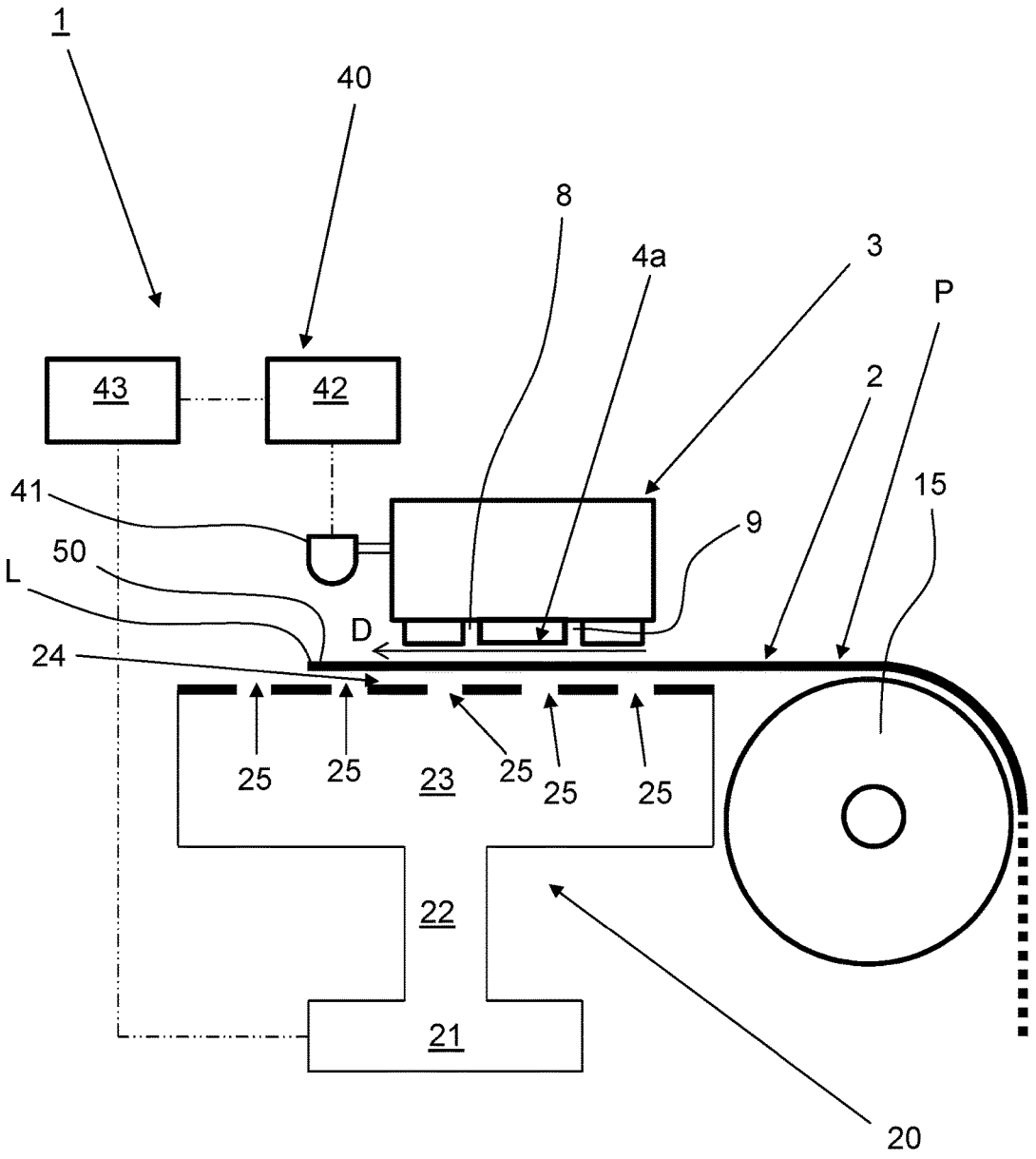
FIG. 3 is a schematic enlarged cross-sectional view of the medium holding device of the image forming apparatus in FIG. 2.

FIG. 3 depicts in more detail the medium holding device 20 according to the present invention. An image receiving member 2 is pushed over the medium support surface 24 of the medium holding device 20 by the drive roller 15. A suction force is applied to the image receiving member 2 via vacuum holes 25 in the medium support surface 24. The vacuum holes 25 are in fluid connection with a cavity 23 or chamber, which cavity 23 is connected to the suction unit 21 via connector 22. As the image receiving member 2 is held against the medium support surface 24 by a vacuum force, the inkjet printing assembly 3 may print a swath of an image on the image receiving member 2. The drive roller 15 then advances the image receiving member 2 a step further along the transport path P in a transport direction indicated by arrow D. Downstream of the inkjet printing assembly 3, a sensor device 41 is provided for detecting an advancement of the image receiving member 2. Said sensor device may for example be a CCD camera, a line scanner, or an array of photo-detectors arranged for determining the position of the image receiving member 2 on the medium support surface 24. Preferably, the sensor device 41 is arranged for continuously or intermittently determining the position of the image receiving member 2 along the transport path P, specifically after each advancement step of the drive roller 15. The sensor device 41 generates advancement data, representing the stepwise advancement of the image receiving member 2, and transmits this data to a processor 42. The processor 42 analyzes the advancement data by comparing the advancement data to a reference, such as a step size setpoint, based upon which comparison the vacuum level in the cavity 23 is adjusted to prevent the image receiving member 2 from deforming and/or being released from the medium support surface 24.

In a preferred embodiment, an advancement indicator 50 is provided on the image receiving member 2. The sensor device 41 is arranged for sensing the advancement indicator 50. The processor 42 in turn is able to determine the advancement of the image receiving member 2 based on data from the sensor device 41. Preferably, the inkjet printing assembly 3 is arranged for printing an advancement indicator 50 on the image receiving member 2. The advancement indicator 50 may comprise a plurality of markers, such as lines or dots, spaced apart from one another in the direction D of the transport path P. Preferably, markers may further be spaced apart from one another in a width direction of the image receiving member perpendicular to the direction D, e.g. to allow for the comparison of rows of markers to one another. The inkjet printing assembly 3 is arranged for printing a swath of the advancement indicator 50 on the image receiving member 2, for example an indicator line (51-56 in FIG. 3) extending in the width direction of the image receiving member 2. The advancement indicator 50 will be discussed in more details in FIGS. 5 to 7. Upon completion of printing a swath of the advancement indicator 50, the drive roller 15 transports image receiving member 2 a step further along the transport path P, preferably based on a step size setpoint output by the control unit 40. When the image receiving member 2 has advanced a step, the inkjet printing assembly 3 applies a further swath of the advancement indicator 50 on the image receiving member 2. These steps of advancing the image receiving member 2 and applying a swath of the advancement indicator 50 on the image receiving member 2 may be repeated in an alternating manner. The advancement indicator 50 is continually provided on the image receiving member 2 during "lead-in" and preferably thereafter. The advancement indicator 50 thus comprises information regarding the latest advancement step and preferably one or more advancement steps performed prior to said latest advancement step.

The image receiving member 2 is pushed by the drive roller 15 in consecutive steps over the medium holding device 20. The medium support surface 24 of the medium holding device 20 upon which medium support surface 24 the image receiving member 2 rests is formed by a horizontal plate 24 provided with a plurality of through-holes or vacuum holes 25. The vacuum holes 25 are in fluid connection with a cavity 23 inside the medium support device 20. A vacuum or vacuum level is applied to the cavity 23 by means of a suction unit 21 connected to the cavity 23 via conduit 22. The suction unit 21 may a vacuum pump or fan. The suction unit 21 is arranged for controlling the vacuum level in the cavity 23 (or chamber 23) and thereby the airflow through the vacuum holes 25 in the medium support surface 24. The vacuum level determines the suction force applied to the image receiving member 2 via the vacuum holes 25. The suction or vacuum force on the image receiving member 2 results in a friction force acting in a direction opposite to the transport direction D. When said friction level exceeds a certain critical value the image receiving member 2 on the medium support surface 24 is deformed or reoriented as the drive roller 15 pushes the image receiving member 2 further upstream. Basically, an upstream part of the image receiving member 2 is locally held in place against the medium support surface 24, while a downstream part of said image receiving member 2 is stepwise pushed further upstream. Since the image receiving member 2 cannot advance unimpeded, it deforms and/or reorients itself on the medium support surface 24. Repositioning or deforming the image receiving member 2 in between the printing of consecutive swaths of an image 70 results in the swaths becoming misaligned with respect to one another, reducing the image quality.

Adjustment of the vacuum level is particularly difficult while leading a leading edge L of the image receiving member 2 through the image forming apparatus 1. FIG. 3 illustrates the advancement of the leading edge L over the medium support surface 24 during "lead-in". As the leading edge L is pushed along the transport path P in the direction D, a leading edge region of the image receiving member 2 covers an increasing area of the medium support surface 24. During each advancement step of the image receiving member 2, an increasing number of vacuum holes 25 become covered by the leading edge L, as the image receiving member 2 is stepwise advanced over the medium holding device 20. Since the number of vacuum holes 25 being covered changes during the advancement of the leading edge L, the vacuum level in the cavity 23 varies between advancement steps. In consequence, the suction force on the image receiving member 2, specifically on a leading edge region of the image receiving member 2 adjacent the leading edge L, changes during "lead-in". To prevent deformation or misorientation of the image receiving member 2 the vacuum level applied by the suction unit 21 is preferably set to a vacuum level sufficiently low to allow to unimpeded or predictable advancement of the image receiving member 2. Thereby, the friction force on a region of the image receiving member 2 above the medium support surface 24 is reduced. However, the vacuum level should still be sufficient to prevent the image receiving member 2 from locally releasing from the medium support surface 24 and to prevent the image receiving member 2 from coming into contact with a print head 4*a*. Thereto, the vacuum level is adjusted based on the input of the sensor device 41, which determines the advancement of the image receiving member 2 per advancement step.

The sensor device 41 is provided (directly) upstream of the inkjet printing assembly 3, preferably on a carriage comprising the inkjet printing assembly 3. The sensor device 41 is arranged for sensing or detecting the swath-wise printed advancement indicator 50, for example by means of an optical sensor such a CCD camera or an optical scanner. The sensor device 41 measures the advancement indicator 50 and based thereon generates advancement data. The advancement data comprises information representing the advancement of the image receiving member 2 during an advancement step. The advancement data may comprise the relative position or spacing of a first advancement marker 51 printed in a first swath with respect to a second advancement marker 52 printed in a second swath after advancing the image receiving member 2 by an advancement step. The advancement data is input to a processor 42 arranged for determining a step size, i.e. the distance wherein the image receiving member 2 was transported along the transport path P in a single advancement step, from the size and/or orientation of said spacing between markers. In an example embodiment, the advancement indicator 50 is printed on the image receiving member 2 prior to the actual "lead in". The image receiving member 2 is then retracted and "lead in" during which the advancement indicator 50 is sensed, reducing the time required for "lead in". In this example, the deformation of the advancement indicator 50 compared to a reference pattern may further be applied for determining the advancement of the image receiving member 2.

The processor 42 compares the advancement data to a reference. The reference may be a step size setpoint or spacing stored on a memory. Alternatively, the reference may correspond to a prior advancement indicator 50 sensed during a prior advancement step. The processor 42 is then arranged for comparing advancement of, preferably consecutive, advantage steps. Specifically, the processor 42 is configured to compare consecutive step sizes, wherein a previously determined step size serves as the reference. In a basic embodiment, the reference may comprise a reference pattern formed by regularly spaced markers, such as a grid. The indicator pattern 50 may then be formed by swath-wise printing said reference pattern on the image receiving member 2. In a further example, the reference comprises a range, or one or more thresholds corresponding to a desired step size for advancing the image receiving member 2.

The processor 42 transmits the results of the comparison between the advancement data and the reference to the suction unit controller 43. The suction unit controller 43 controls or adjusts the suction source 41 in correspondence to the determined advancement step size. Specific examples of the workings of the control unit 40 are described below.

Figure 4:
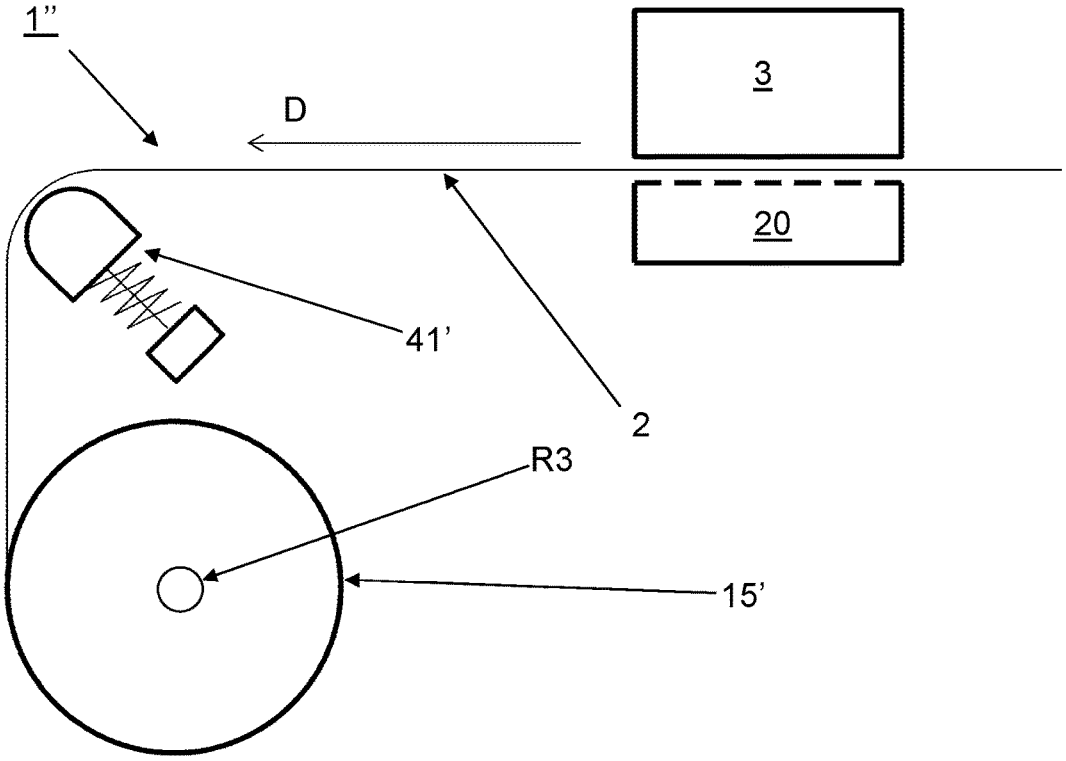
FIG. 4 is a schematic side view of an even further embodiment of an image forming apparatus according to the present invention.

In the embodiment of the image forming apparatus 1" in FIG. 4, the sensor device 41' comprises a tension sensor 41' in the form of a buffer device 41', which is pretensioned against the image receiving member 2. The roll support R3 is positioned downstream of the inkjet printing assembly 3 for receiving printed medium. A drive roller 15' is provided for said roll support R3 for providing a pulling transport of the image receiving member below the inkjet printing assembly 3. The tension sensor 41' is arranged for measuring the tension in the image receiving member 2. When the suction force on the image receiving member on the image support surface of the holding device 20 is set too high, the image receiving member 2 is locally fixed below the inkjet printing assembly 3. When the drive roller 15' is then actuated, the image receiving member is pulled and the tension in the medium 2 increases. This tension is then detected by the sensor device 41', upon which the suction force is adjusted, specifically lowered, to prevent tearing of the medium 2.

Example 1

Figure 5:
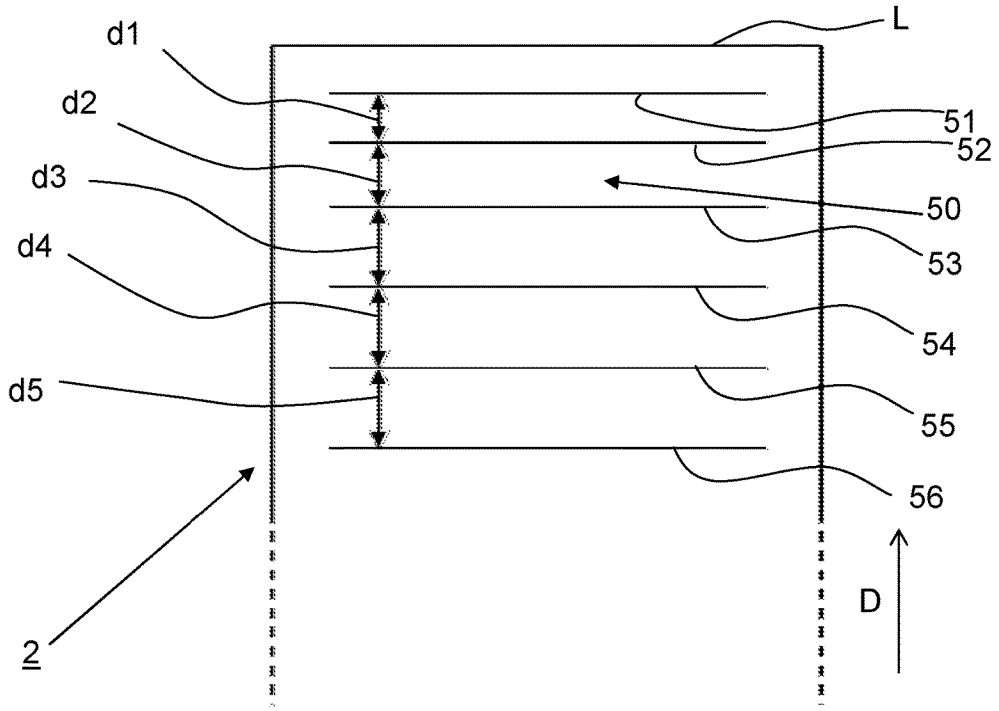
FIG. 5 is a schematic top view of a leading edge of web provided with an advancement indicator according to the present invention in case of a relatively high initial suction force.

FIG. 5 depicts a leading edge L of an image receiving member 2, which image receiving member 2 may be a medium such as a web. An advancement indicator 50 in the form an indicator pattern 50 has been deposited on the image receiving member 2 in a leading edge region adjacent or near the leading edge L. The advancement indicator 30 extends from the leading edge L in the longitudinal direction of the image receiving member 2 and is formed by a plurality of markers 51-56. The line-shaped markers 51-56 in FIG. 5 were printed in consecutive swaths. A first marker 51 was printed upon the image receiving member 2 near the leading edge L, whereupon the image receiving member 2 was advanced in the direction D by an advancement step, followed by the printing of a second marker 52 on a side of the first marker 51 opposite of the leading edge L. Likewise, further markers 53-56 may be deposited after one another in consecutive swaths. Since the print head 4*a* is static in the transport direction D, the spacing d1 between the first and second markers 51, 52 is determined by the advancement step. As such, the processor 42 may derive the advancement step size from the spacing d1. In FIG. 5, the first spacing d1 between the first and second markers 51, 52 is smaller than a second spacing d2 between the second and third markers 52, 53, which indicates a decrease in the friction force on the image receiving member 2. Likewise, the spacing d3 between a fourth marker 54 and the third marker 53 is greater than the spacing d2. The spacings d4, d5 between further markers 54, 55, 56 are however of similar size.

During operation, after printing the second marker 52 the processor 42 determined the first spacing d1 from the data generated by the sensor device 41. The third marker 53 is then printed and the processor 42 compares the second spacing d2 to the first spacing d1, which deviate from one another. The control unit 40 then adjusts, in this case decreases, the vacuum level, after which the image receiving member 2 is advanced by a further step and another marker 54 is printed. Since the spacing d3 differs from the spacing d2, the control unit 40 readjusts the vacuum level to an even lower level. The following spacings d4, d5 are substantially equal to the spacing d3. Thereby, the desired vacuum level for reliably advancing the medium 2 has been determined and preferably the latter vacuum level is selected and/or maintained. In this example, the control unit 42 sets the initial vacuum level relatively high, i.e. at a level known to result in localized holding of the image receiving member 2. The control unit 42 then stepwise lowers the vacuum level until the step spacing d1-d5 becomes constant. The processor 42 may further be arranged to determine a straightness factor for each line-shaped marker 51-56, such that any deformation such as wrinkling of the image receiving member 2 may be derived from said straightness factor.

Example 2

Figure 6:
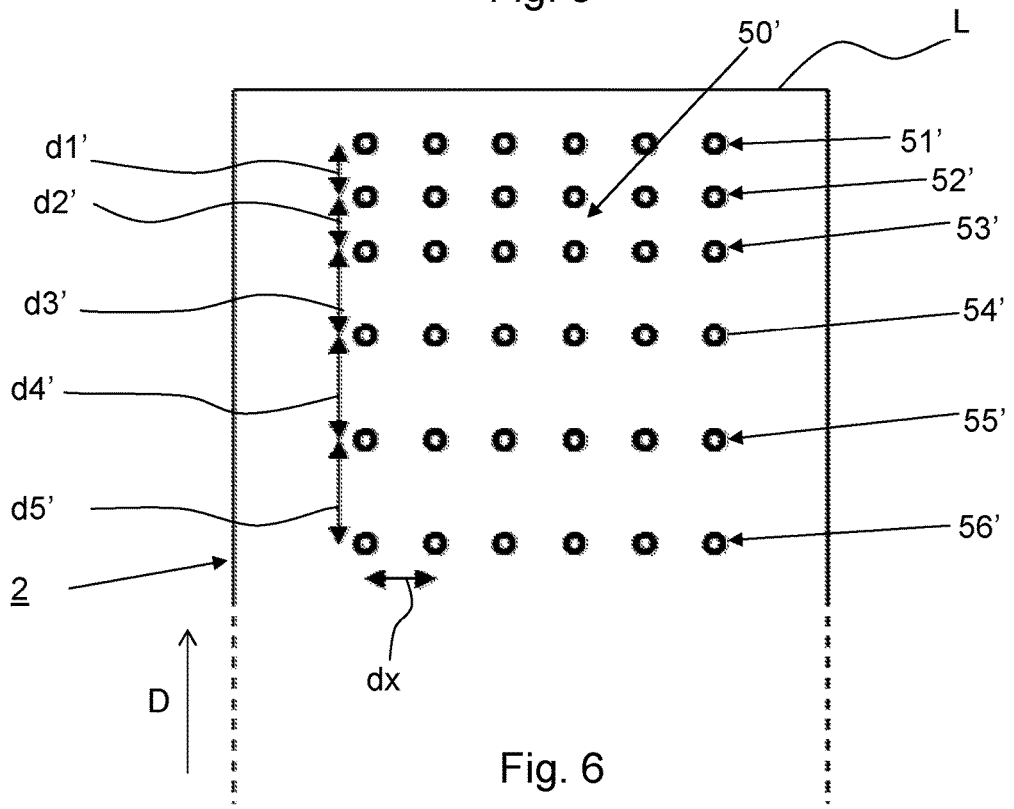
FIG. 6 is a schematic top view of a leading edge of web provided with an advancement indicator according to the present invention in case of a relatively low initial suction force compared to FIG. 5.

The advancement indicator 50' in FIG. 6 is formed by swath-wise printed rows of markers 51'-56' provided in a grid. The processor 42 is arranged for determining the longitudinal spacing d1'-d5' between markers 51'-56' and preferably for determining a lateral spacing dx between markers 51'-56'. In the example in FIG. 6, the control unit 42 sets the initial vacuum level relatively low or at zero to ensure unimpeded progress of the image receiving member 2 over the medium support surface 24. It can be seen that the top step spacings d1', d2' are similar. The control unit 42 then adjusts the vacuum level until the step spacing d1'-d5' begins to deviate. Preferably, the control unit 42 then adjusts, specifically lowers, the vacuum level to obtain a constant step size, for example in the manner described in example 1. The control unit 42 may further utilize the lateral spacing 42 to determine whether the vacuum level results in rotation or deformation of the image receiving member 2.

In practice, the vacuum level takes some time stabilize, which in some systems may take more time than printing a swath of the advancement indicator, thereby increasing production time. It is then preferred to analyze to data corresponding to two or more advancement steps for determining a suitable vacuum level. To this end, an advancement curve may then be determined from said advancement data, which is then compared to a reference curve. The accuracy is further increased when a first marker is compared to a plurality of further markers, each of which was printed in a different swath.

Figure 8:
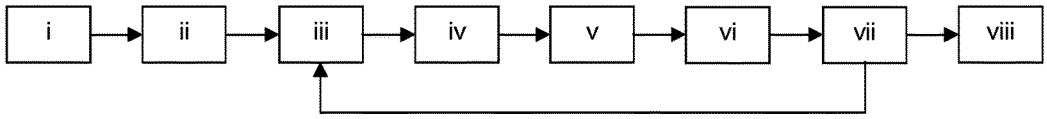
FIG. 8 is a diagram representing the steps of the method according to the present invention.

FIG. 8 schematically illustrates various steps of the method according to the present invention. In step i, the image receiving member 2 with the leading edge L is inserted into the image forming apparatus 1. The leading edge L is advanced until it is positioned above the medium support surface 24 and below the inkjet printing assembly 3. In step ii an initial vacuum level is applied to the chamber 23 by means of the suction unit 21. In step iii, a swath of the advancement indicator 50 is printed on the image receiving member 2 by the inkjet printing assembly 3. The advancement indicator 50 may be a plurality of markers arranged in a row or pattern. In step iv, the image receiving member 2 is advanced a step by actuating the drive roller 15 to a predefined position or over an predefined angle. During advance, the actual advancement of the image receiving member 2 may deviate from the predefined step size setpoint of the drive roller 15 due to friction forces acting between the image receiving member 2 and the medium support surface 24. During "lead-in" in step iv, the leading edge region of the image receiving member 2 is stepwise transported over the medium support surface 24, thereby covering an increasing number of vacuum holes 25. The changing vacuum hole coverage affects the suction force on the leading edge region. In step v, the advancement indicator 50 is sensed by the sensor device 41, which generates advancement data related to an advancement step of the image receiving member 2. The advancement data is transmitted to the processor 42, which in step vi compares the advancement data to the reference. In step vi, the processor determines whether the medium advancement derived from the advancement data deviates from the desired advancement defined by the predefined rotation of the drive roller 15. In this step an advancement step size or advancement curve may be compared to a reference curve or step size. To obtain the advancement curve, steps iii to vi may be cyclically repeated before proceeding to step vii. This is particularly advantageous during "lead-in" wherein the suction force further changes due to the advancement of the leading edge over the vacuum holes 25. Based upon the comparison, the suction unit controller 43 of the control unit 40 selects the suction force by controlling the suction unit 21 in step vii. The step vii may comprise increasing the suction force when the advancement data is similar to the reference and/or decreasing the suction force when the advancement data deviates from the reference. The suction force may further be determined from the deviation between the reference curve and the advancement. Step iii to vii may be repeated until a suitable suction force or vacuum level has been determined and/or until the end of the printing process, which is indicated by step viii.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for calibrating a vacuum level for a web-based image forming system, the method comprising the steps of:

transporting an image receiving member over a medium support surface, which medium support surface comprises vacuum holes for applying a suction force to the image receiving member;

applying a suction force to the image receiving member on the medium support surface; and after the step of applying the suction force to the image receiving member, performing the following steps:

determining the advancement of the image receiving member for generating advancement data;

comparing the advancement data to a reference; and adjusting the suction force to said image receiving member based on the comparison between the advancement data and the reference, wherein the step of determining the advancement of the image receiving member further comprises:

determining a first and a second advancement step size by which a medium has been transported over the medium support surface, and wherein the step of comparing further comprises comparing the determined first and second advancement step sizes to one another.

2. The method according to claim 1, wherein the step of determining the advancement of the image receiving member comprises sensing an advancement indicator on the image receiving member.

3. The method according to claim 2, further comprising a step of printing a swath of the advancement indicator on the image receiving member.

4. The method according to claim 3, wherein the advancement indicator is formed by a plurality of swath-wise printed spaced apart markers wherein the step of comparing the advancement data comprises determining a spacing between two markers of the plurality of swath-wise printed markers.

5. The method according to claim 1, wherein the step of comparing the advancement data to the reference comprises:

a step of determining an advancement step size; and a step of comparing the advancement step size to a reference step size.

6. The method according to claim 5, further comprising the step of:

determining an upper limit for the suction force at which upper limit the advancement step size begins to deviate from the reference step size; and wherein the step of adjusting the suction force further comprises setting the suction force below the determined upper limit.

7. The method according to claim 1, wherein the step of adjusting the suction force comprises reducing the suction force when the advancement data deviates from the reference.

8. The method according to claim 1, wherein the step of adjusting the suction force comprises increasing the suction force when the advancement data is similar to the reference.

9. The method according to claim 1, further comprising the step of printing a swath of the advancement indicator along an edge of the image receiving member.

10. An image forming apparatus, comprising:

a roll support for an image receiving member, which roll support is positioned at an end of a transport path for supplying a web onto the transport path;

an inkjet printing assembly positioned along the transport path and arranged for applying an image on the image receiving member;

a medium support surface positioned along the transport path opposite the inkjet printing assembly, which medium support surface is provided with vacuum holes for supplying a suction force to the image receiving member;

a suction unit for controlling an air flow through the vacuum holes;

a sensor device arranged for determining the advancement of the image receiving member by determining a first and a second advancement step size by which a medium has been transported over the medium support surface and for generating advancement data; and a control unit comprising a processor arranged for a comparison between the advancement data and a reference, wherein the control unit is configured to:

control the suction unit to apply an initial vacuum level for determining a suction force to the image receiving member on the medium support surface;

compare the determined first and second advancement step sizes to one another; and control the suction unit to adjust the suction force to said image receiving member from the initial vacuum level to a vacuum level different from the initial vacuum level based on said comparison.

11. The image forming apparatus according to claim 10, wherein the inkjet assembly is arranged for providing an advancement indicator on the image receiving member, and wherein the sensor device is arranged for sensing the advancement indicator on the image receiving member.

12. The image forming apparatus according to claim 11, wherein the inkjet assembly is arranged for providing an advancement indicator on the image receiving member, which advancement indicator is formed by a plurality of swath-wise printed spaced apart markers, and wherein the processor is further arranged for determining an advancement step size by determining a spacing between two markers of the plurality of swath-wise printed markers.

13. The image forming apparatus according to claim 10, wherein the processor is further arranged for determining an advancement step size and for comparing the advancement step size to a reference step size.

14. The image forming apparatus according to claim 13, wherein the control unit is arranged for reducing the suction force when the advancement step size deviates from the reference step size.

15. The image forming apparatus according to claim 10, wherein the advancement indicator comprises a plurality of markers spaced apart with respect to one another in a transport direction of the transport path.

16. A method for calibrating a vacuum level for a web-based image forming system, the method comprising the steps of:

transporting an image receiving member over a medium support surface, which medium support surface comprises vacuum holes for applying a suction force to the image receiving member;

applying an initial vacuum level for determining a suction force to the image receiving member on the medium support surface; and after the step of applying the initial vacuum level, performing the following steps:

determining the advancement of the image receiving member for generating advancement data;

comparing the advancement data to a reference; and adjusting the suction force based on the comparison between the advancement data and the reference to a vacuum level different from the initial vacuum level, wherein the step of determining the advancement of the image receiving member further comprises:

determining a first and a second advancement step size by which a medium has been transported over the medium support surface, and wherein the step of comparing further comprises comparing the determined first and second advancement step sizes to one another.

17. The method according to claim 16, wherein the step of adjusting is performed when the first and second advancement steps deviate from one another.

* * * * *